US008347867B2

(12) United States Patent
Zumbaugh et al.

(10) Patent No.: US 8,347,867 B2
(45) Date of Patent: Jan. 8, 2013

(54) SYSTEM AND METHOD FOR PROTECTING ENGINE FUEL PUMPS

(75) Inventors: Michael C. Zumbaugh, Troy, MI (US); Kauser Ferdous, West Bloomfield, MI (US); Jon C. Miller, Fenton, MI (US)

(73) Assignee: GM Global Technology Operations LLC

( * ) Notice: Subject to any disclaimer, the term of this patent is extended or adjusted under 35 U.S.C. 154(b) by 748 days.

(21) Appl. No.: 12/569,256

(22) Filed: Sep. 29, 2009

(65) Prior Publication Data

US 2010/0326413 A1 Dec. 30, 2010

Related U.S. Application Data

(60) Provisional application No. 61/221,786, filed on Jun. 30, 2009.

(51) Int. Cl.

| | |
|---|---|
| ***F02M 37/00*** | (2006.01) |
| *F02D 41/00* | (2006.01) |
| *F02M 37/10* | (2006.01) |

(52) U.S. Cl. ..... 123/703; 123/512

(58) Field of Classification Search ..... 123/703, 123/512, 510, 513, 497

See application file for complete search history.

(56) References Cited

U.S. PATENT DOCUMENTS

| | | | | |
|---|---|---|---|---|
| 4,617,116 | A * | 10/1986 | Seiler | 123/514 |
| 4,683,864 | A * | 8/1987 | Bucci | 123/575 |
| 6,588,449 | B1 * | 7/2003 | Kippe | 123/509 |

FOREIGN PATENT DOCUMENTS

DE 19805072 A1 * 8/1999

* cited by examiner

*Primary Examiner* — Hieu T Vo

(57) ABSTRACT

A fuel control system for an internal combustion engine includes a fuel starvation detection module and a fuel pump protection module. The fuel starvation detection module detects when a fuel pump is delivering less than a predetermined amount of fuel based on a fuel level in a fuel tank, a fuel pressure in the fuel pump, and an air/fuel (A/F) ratio of the engine. The fuel pump protection module decreases an amount of fuel supplied to the engine during a period after detecting that the fuel pump is delivering less than the predetermined amount of fuel.

20 Claims, 3 Drawing Sheets

SYSTEM AND METHOD FOR PROTECTING ENGINE FUEL PUMPS

CROSS-REFERENCE TO RELATED APPLICATIONS

This application claims the benefit of U.S. Provisional Application No. 61/221,786, filed on Jun. 30, 2009. The disclosure of the above application is incorporated herein by reference in its entirety.

FIELD

The present disclosure relates to internal combustion engines and more particularly to a system and method for protecting fuel pumps.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel (A/F) mixture within a plurality of cylinders to drive pistons that generate drive torque. Air is drawn into an intake manifold through an inlet that may be regulated by a throttle. Fuel may then be injected into the intake manifold (i.e. port fuel injection) or into each of the plurality of cylinders (i.e. direct fuel injection) to create the A/F mixture. A fuel system may adjust the rate that fuel is injected to provide a desired A/F mixture to the plurality of cylinders. For example, increasing the amount of air and fuel provided to the cylinders may increase the torque output of the engine.

The fuel system may further include, but is not limited to, fuel tanks, fuel pumps, and fuel injectors. For example, a low pressure fuel pump may draw fuel from a fuel tank, pressurize the fuel, and supply low pressure fuel to either a port injector or to a high pressure fuel pump. In other words, a direct injection engine system, such as a spark ignition, direct injection (SIDI) engine, may include an additional fuel pump. The high pressure pump may further pressurize the fuel and supply high pressure fuel to one or more fuel injectors.

SUMMARY

A fuel control system for an internal combustion engine includes a fuel starvation detection module and a fuel pump protection module. The fuel starvation detection module detects when a fuel pump is delivering less than a predetermined amount of fuel based on a fuel level in a fuel tank, a fuel pressure in the fuel pump, and an air/fuel (A/F) ratio of the engine. The fuel pump protection module decreases an amount of fuel supplied to the engine during a period after detecting that the fuel pump is delivering less than the predetermined amount of fuel.

A method includes detecting when a fuel pump is delivering less than a predetermined amount of fuel based on a fuel level in a fuel tank, a fuel pressure in the fuel pump, and an air/fuel (A/F) ratio of the engine, and decreasing an amount of fuel supplied to the engine during a period after detecting that the fuel pump is delivering less than the predetermined amount of fuel.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
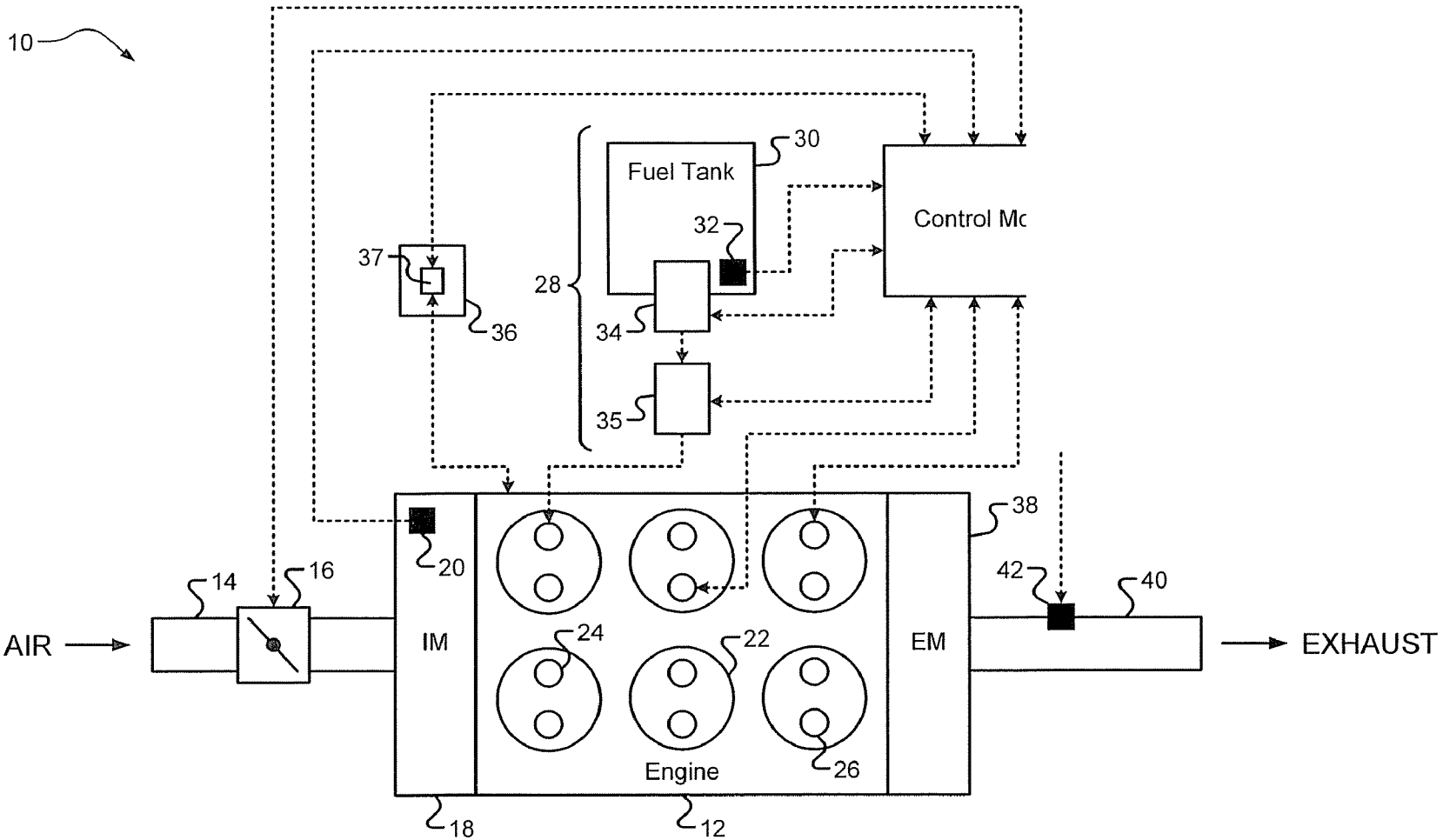
FIG. 1 is a functional block diagram of an exemplary engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Internal combustion engines may stall and/or suffer damage when an operating with an insufficient supply of fuel, more commonly referred to as fuel starvation, fuel exhaustion, or fuel depletion. Fuel pumps may be damaged when fuel starvation occurs. More specifically, fuel pump motors may be damaged due to friction when there is insufficient liquid fuel to pump (and thus fuel vapor or air is pumped instead). Moreover, engine control systems may adapt to a decreasing fuel supply, and thus the fuel pumps may continue to operate during fuel starvation until the engine eventually stalls. The extended operation of the fuel pumps during fuel starvation may severely damage the fuel pumps.

Therefore, a system and method detect fuel starvation of a fuel pump and controls the fuel system to prevent damage to one or more fuel pumps. More specifically, the system and method monitor both fuel pressure and an A/F ratio of the engine to detect when the fuel pump is delivering less than a predetermined amount of fuel. For example, the system and method may monitor a difference between a desired fuel pressure and an estimated fuel pressure. Additionally, for example, the system and method may monitor a signal from an oxygen sensor in an exhaust system. The fuel starvation condition may be reset after one of an engine start event, an engine stop event, and a stall of the engine.

After detection of fuel starvation, the system and method may command a predetermined fuel pump pressure corresponding to a predetermined A/F ratio. For example, the predetermined A/F ratio may be an increased (i.e. leaner) A/F ratio. The system and method may also reset any fuel correction (short term or long term) currently being implemented. Furthermore, in direct injection engine systems (e.g. SIDI), the system and method may disable a high pressure fuel pump.

Referring now to FIG. 1, an exemplary engine system 10 includes an engine 12. The engine 12 draws air into an intake manifold 18 through an inlet 14 that is regulated by a throttle 16. A manifold absolute pressure (MAP) sensor 20 measures pressure inside the intake manifold 18. The air in the intake manifold 18 is then distributed to a plurality of cylinders 22. Each of the plurality of cylinders 22 may include a fuel injector 24 and a spark plug 26. While a spark-ignition, direct-injection (SIDI) engine 12 is shown, it can be appreciated that the system and method of the present disclosure may be implemented in a port-injection engine. In other words, fuel may be injected via a port in the intake manifold 18 and the air/fuel (A/F) mixture that is created may then be distributed to the plurality of cylinders 22.

Each of the fuel injectors 22 receives pressurized fuel from a fuel system 28. The fuel system 28 may include a fuel tank 30, a fuel level sensor 32, a low pressure fuel pump 34, and a high pressure fuel pump 35. While the fuel system 28 is shown to include the high pressure fuel pump 35, a port injection engine (i.e. not direct-injection) may implement the low pressure fuel pump 34 supplying fuel directly to a port injector. The fuel tank 30 includes fuel for operation of the engine 12. The fuel level sensor 32 measures a fuel level in the fuel tank 30. For example, the fuel level sensor 32 may generate a signal when the fuel level is less than a predetermined fuel level threshold.

The low pressure fuel pump 34 pumps fuel from the fuel tank 30 to the high pressure fuel pump 35. As previously stated, in port fuel injection implementations the low pressure fuel pump 34 may pump the fuel from the fuel tank 30 to a port fuel injector. The high pressure fuel pump 35 further pressurizes the fuel and delivers the high pressure fuel to the fuel injectors 24.

The fuel injectors 24 inject the high pressure fuel into the cylinders 22. The A/F mixture in the cylinders 22 is combusted using the spark plugs 26, which drives pistons (not shown) that rotatably turn a crankshaft (not shown) generating drive torque. Exhaust gas resulting from combustion is vented from the cylinders 22 into an exhaust manifold 38. Exhaust gas is then expelled from the engine 12 through an exhaust system 40. An oxygen sensor 42 may measure an oxygen level of the exhaust gas. For example, the oxygen level may be used to estimate the A/F ratio of engine 12.

A fuel vapor canister 36 stores fuel vapor in the engine 12 and may be purged to release the fuel vapor and/or pressure. More specifically, the fuel vapor canister 36 may include a purge valve 37 that may be actuated (i.e., opened) to purge the fuel vapor canister 36.

A control module 50 controls operation of the engine system 10. The control module 50 may both monitor and actuate each of the throttle 16, the fuel injectors 24, the spark plugs 26, the low pressure fuel pump 34, the high pressure fuel pump 35, the fuel vapor canister 36, and the purge valve 37. The control module 50 also receives signals from the MAP sensor 20, the fuel level sensor 32, and the oxygen sensor 42. The control module 50 may implement the system and method of the present disclosure to protect the fuel pumps 34, 35.

Figure 2:
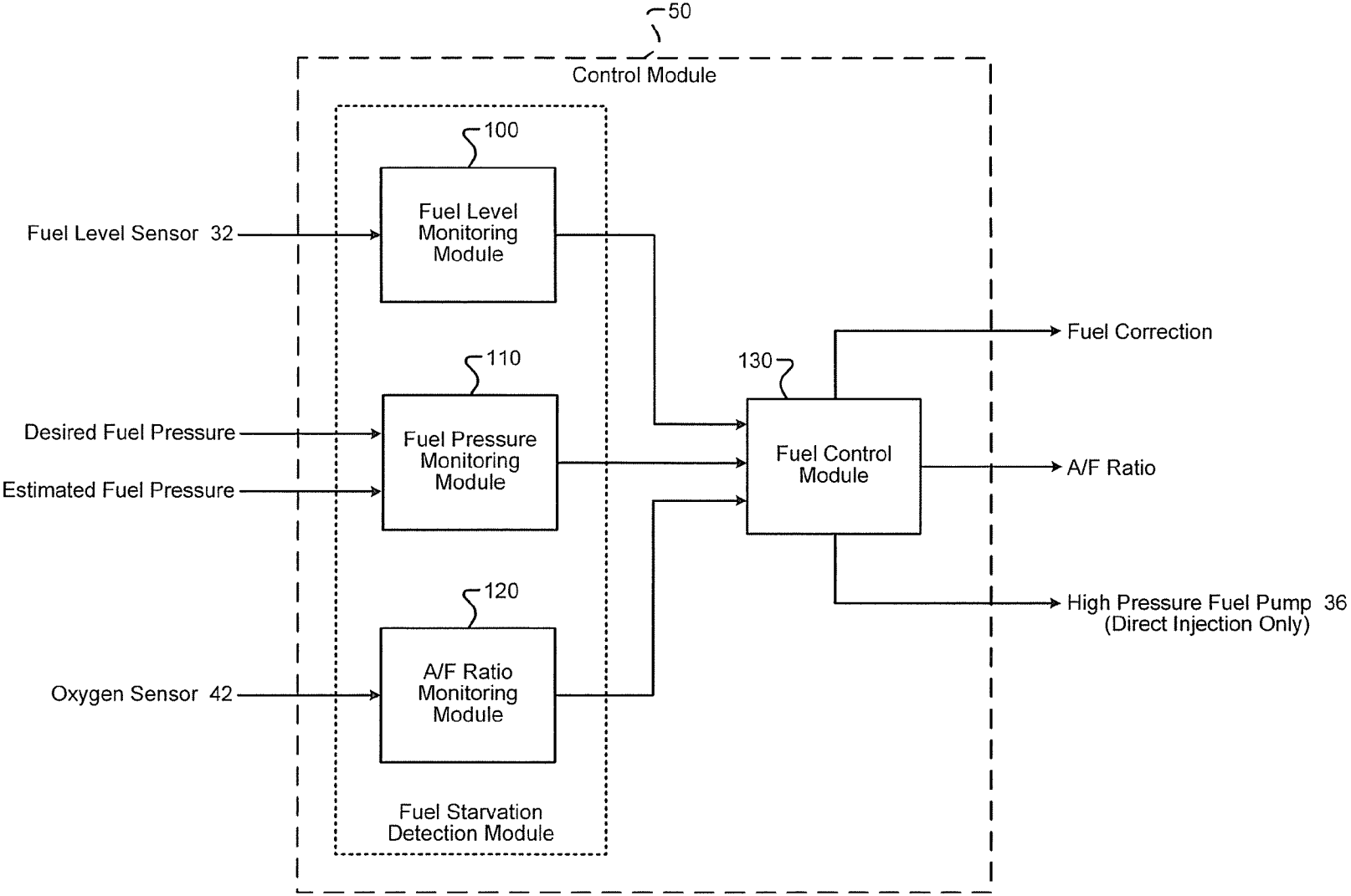
FIG. 2 is a functional block diagram of an exemplary control module according to the present disclosure.

Referring now to FIG. 2, the control module 50 is shown in more detail. The control module 50 may include a fuel level monitoring module 100, a fuel pressure monitoring module 110, an A/F ratio monitoring module 120, and a fuel control module 130. The fuel level monitoring module 100, the fuel pressure monitoring module 110, and the A/F ratio monitoring module 120 may be collectively referred to as a fuel starvation detection module. In other words, these modules may collectively determine whether the fuel pumps 34, 35 are in a fuel starvation state (i.e. delivering less than a predetermined amount of fuel).

The fuel level monitoring module 100 may receive a fuel level signal from the fuel level sensor 32 corresponding to a fuel level in the fuel tank 30. The fuel level monitoring module 100 may detect a first condition corresponding to when the fuel level in the fuel tank 30 is less than a predetermined fuel level. The fuel level monitoring module 100 may then generate a low fuel level signal when the first condition is detected. Alternatively, in one embodiment (previously discussed) the fuel level sensor 32 may generate a low fuel level signal when the fuel level in the fuel tank 30 is less than the predetermined fuel level.

The fuel pressure monitoring module 110 may receive a desired fuel pressure and an estimated fuel pressure. For example only, the desired fuel pressure may be based on input by a driver (e.g., position of an accelerator pedal). Alternatively, for example only, the desired fuel pressure may be based on other engine operating parameters such as airflow and spark timing. In one embodiment, the estimated fuel pressure may be based on a measurement from a fuel pressure sensor (not shown). However, it can be appreciated that the estimated fuel pressure may be based on other sensors and/or engine operating parameters.

The fuel pressure monitoring module 110 may detect a second condition corresponding to when a difference between the desired fuel pressure and the estimated fuel pressure is less than a predetermined pressure for a first predetermined period of time. In one embodiment, the fuel pressure monitoring module 110 may detect the second condition after the first condition has been detected. The fuel pressure monitoring module 110 may then generate a low fuel pressure signal when the second condition is detected.

The A/F ratio monitoring module 120 may receive a signal from the oxygen sensor 42 in the exhaust system 40. The A/F ratio monitoring module may determine an A/F ratio of the engine 12 based on the received oxygen signal. The A/F ratio monitoring module 120 may detect a third condition corresponding to when the A/F ratio of the engine is greater than a predetermined A/F ratio. In one embodiment, the A/F ratio monitoring module 120 may detect the third condition when the voltage of the oxygen signal is greater than a predetermined voltage for a second predetermined period of time. In one embodiment, the A/F ratio monitoring module 120 may detect the third condition after the second condition has been detected. The A/F ratio monitoring module 120 may then generate a lean A/F ratio signal when the third condition is detected.

The fuel control module 130 receives the low fuel level signal, the low fuel pressure signal, and the lean A/F ration signal. The fuel control module 130 may control operation of the engine system 10 to protect the fuel pumps 34, 35 from damage during fuel starvation when all three received signals are in a first state (i.e. all three conditions are detected). The control module 50 may reset the low fuel level signal, the low fuel pressure signal, and the lean A/F ratio signal when one of an engine start event, an engine stop event, or a stall of the engine occurs.

More specifically, the fuel control module 130 may command fuel pressure to a predetermined fuel pressure. For example, the predetermined fuel pressure may correspond to a lean A/F ratio to lead to an engine stall. In one embodiment, the fuel control module 130 may control the fuel pressure (or the A/F ratio of the engine 12) by actuating at least one of the throttle 16, the fuel injectors 24, and the spark plugs 26. The fuel control module 130 may also disable both short term and long term fuel correction to prevent extended operation of the fuel pumps 34, 35 during fuel starvation. Additionally, the fuel control module 130 may disable the high pressure fuel pump 35 (in SIDI applications only) to prevent extended operation of the fuel pumps 34, 35 during fuel starvation.

Referring now to FIG. 3, a method for preventing damage to the one or more fuel pumps begins in step 200. In step 202, the control module 50 determines whether a fuel level in the fuel tank 30 is less than a predetermined fuel level threshold. For example, the fuel level may be generated using the fuel level sensor 32. If true, control may proceed to step 204. If false, control may proceed to step 206.

In step 204, the control module 50 may determine whether a fuel pressure is less than a predetermined fuel pressure threshold. For example, the fuel pressure may be a difference between a desired fuel pressure and an estimated fuel pressure. If true, control may proceed to step 208. If false, control may proceed to step 210.

In step 206, the control module 50 may perform a reset procedure (described in detail below and in FIG. 3B). Control may then proceed to step 220. In step 208, the control module 50 may disable purging of the fuel vapor canister 36. Control may then proceed to step 212. In step 210, the control module 50 may enable purging of the fuel vapor canister 36. Control may then return to step 202.

In step 212, the control module 50 may determine whether an A/F ratio is greater than a predetermined A/F ratio corresponding to a lean A/F condition. For example, the A/F ratio may be determined using the oxygen sensor 42 in the exhaust system 40. If true, control may proceed to step 214. If false, control may return to step 204.

In step 214, the control module 50 may reset fuel correction. In step 216, the control module 50 may command a predetermined default fuel pressure. In other words, the predetermined default fuel pressure may be different than a predetermined normal fuel pressure corresponding to normal engine operation. For example only, the predetermined default fuel pressure may protect the fuel pumps 34, 35. In step 218, the control module 50 may disable the high pressure fuel pump 35 (in SIDI implementations only). In other words, in port injection implementations, control may proceed from step 216 to step 220.

In step 220, the control module 50 may determine whether an engine start event, an engine stop event, or an engine stall event has occurred. If true, control may proceed to step 222. If false, control may return to step 202. In step 222, the control module 50 may perform the reset procedure (described in detail below and in FIG. 3B). Control may then end in step 224.

Figures 3A, 3B:
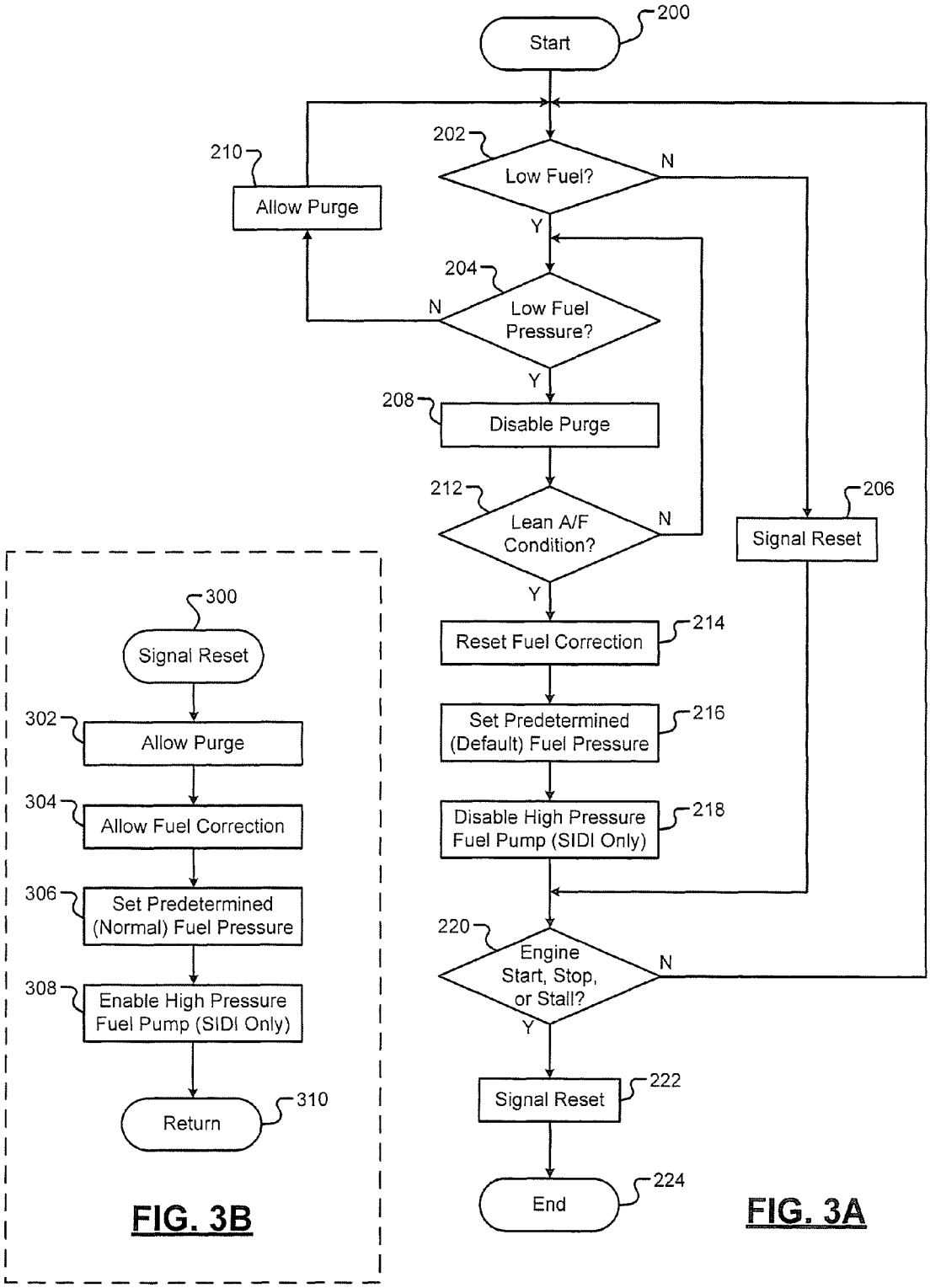
FIG. 3A is a flow diagram of an exemplary method for protecting fuel pumps according to the present disclosure.
FIG. 3B is a flow diagram of an exemplary method for resetting the fuel pump protection method of FIG. 3A.

Referring now to FIG. 3B, a method for resetting fuel pump protection (see above and FIG. 3A) begins in step 300. More specifically, the method described here and shown in FIG. 3B corresponds to steps 206 and 222 in FIG. 3A. In step 302, the control module 50 enables purging of the fuel vapor canister 36. In step 304, the control module 50 may allow (i.e. enable) fuel correction. In step 306, the control module 50 may command the predetermined normal fuel pressure (i.e. different than the predetermined default fuel pressure commanded to protect the fuel pumps 34, 35). In step 308, the control module 50 may enable the high pressure fuel pump 35 (in SIDI implementations only). In other words, in port injection implementations, control may proceed from step 306 to step 310. In step 310, control may return to the appropriate step according to the method in FIG. 3B (e.g., steps 220 or 224).

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel control system for an internal combustion engine, comprising:

a fuel starvation detection module that detects when a fuel pump is delivering less than a predetermined amount of fuel based on a fuel level in a fuel tank, a fuel pressure in the fuel pump, and an air/fuel (A/F) ratio of the engine; and a fuel pump protection module that decreases an amount of fuel supplied to the engine during a period after detecting that the fuel pump is delivering less than the predetermined amount of fuel.

2. The fuel control system of claim 1, wherein the fuel starvation detection module detects when the fuel level in the fuel tank is less than a predetermined fuel level.

3. The fuel control system of claim 2, wherein the fuel starvation detection module detects when the fuel pressure in the fuel pump is less than a predetermined pressure for a first predetermined period.

4. The fuel control system of claim 3, wherein the fuel pressure in the fuel pump includes a difference between a desired fuel pressure and an estimated fuel pressure, and wherein the fuel starvation module detects when the difference is less than the predetermined pressure for the first predetermined period.

5. The fuel control system of claim 3, wherein the fuel starvation detection module detects when the A/F ratio of the engine is greater than a predetermined A/F ratio for a second predetermined period.

6. The fuel control system of claim 5, wherein the A/F ratio of the engine is determined based on a signal from an oxygen sensor indicating an amount of oxygen in exhaust gas produced by the engine, and wherein the fuel starvation detection module detects when the signal is greater than a predetermined voltage for the second predetermined period.

7. The fuel control system of claim 5, wherein the fuel starvation detection module detects that the fuel pump is delivering less than the predetermined amount of fuel when the fuel level in the fuel tank is less than the predetermined fuel level, when the fuel pressure in the fuel pump is less than the predetermined pressure for the first predetermined period, and when the A/F ratio of the engine is greater than the predetermined A/F ratio for the second predetermined period.

8. The fuel control system of claim 1, wherein the fuel pump protection module disables fuel correction and decreases the amount of fuel supplied to the engine during the period until the engine stalls, and wherein the fuel starvation detection module is reset when one of an engine start event, and engine stop event, and a stall of the engine occurs.

9. The fuel control system of claim 5, wherein the fuel pump is a low pressure fuel pump that pressurizes and pumps fuel from the fuel tank, wherein purging of a fuel vapor canister is enabled when one of the fuel level is greater than the predetermined fuel level and the fuel pressure is greater than the predetermined pressure, and wherein purging of the fuel vapor canister is disabled when the fuel pressure is less than the predetermined pressure.

10. The fuel control system of claim 9, further comprising:

a high pressure fuel pump that receives the pressurized fuel from the low pressure fuel pump, that further pressurizes the pressurized fuel, and that supplies high pressure fuel to a plurality of fuel injectors in a plurality of cylinders of the engine, respectively, wherein the engine is a spark-ignition, direct-injection (SIDI) engine, and wherein the high pressure fuel pump is disabled when the fuel level in the fuel tank is less than the predetermined fuel level, when the fuel pressure is less than the predetermined fuel pressure for the first predetermined period, and when the A/F ratio of the engine is greater than the predetermined A/F ratio for the second predetermined period.

11. A method, comprising:

detecting when a fuel pump is delivering less than a predetermined amount of fuel based on a fuel level in a fuel tank, a fuel pressure in the fuel pump, and an air/fuel (A/F) ratio of an engine; and decreasing an amount of fuel supplied to the engine during a period after detecting that the fuel pump is delivering less than the predetermined amount of fuel.

12. The method of claim 11, further comprising:

detecting when the fuel level in the fuel tank is less than a predetermined fuel level.

13. The method of claim 12, further comprising:

detecting when the fuel pressure in the fuel pump is less than a predetermined pressure for a first predetermined period.

14. The method of claim 13, further comprising:

detecting when a fuel pressure difference is less than the predetermined pressure for the first predetermined period, wherein the fuel pressure difference includes a difference between a desired fuel pressure and an estimated fuel pressure in the fuel pump.

15. The method of claim 13, further comprising:

detecting when the A/F ratio of the engine is greater than a predetermined A/F ratio for a second predetermined period.

16. The method of claim 15, further comprising:

detecting when a signal is greater than a predetermined voltage for the second predetermined period, wherein the signal is from an oxygen sensor indicating an amount of oxygen in exhaust gas produced by the engine, and wherein the A/F ratio of the engine is determined based on the signal.

17. The method of claim 15, further comprising:

detecting that the fuel pump is delivering less than the predetermined amount of fuel when the fuel level in the fuel tank is less than the predetermined fuel level, when the fuel pressure in the fuel pump is less than the predetermined pressure for the first predetermined period, and when the A/F ratio of the engine is greater than the predetermined A/F ratio for the second predetermined period.

18. The method of claim 11, further comprising:

disabling fuel correction and decreasing the amount of fuel supplied to the engine during the period until the engine stalls; and resetting the detecting of when the fuel pump is delivering less than the predetermined amount of fuel when one of an engine start event, and engine stop event, and a stall of the engine occurs.

19. The method of claim 15, wherein the fuel pump is a low pressure fuel pump that pressurizes and pumps fuel from the fuel tank, wherein purging of a fuel vapor canister is enabled when one of the fuel level is greater than the predetermined fuel level and the fuel pressure is greater than the predetermined pressure, and wherein purging of the fuel vapor canister is disabled when the fuel pressure is less than the predetermined pressure.

20. The method of claim 19, further comprising:

receiving the pressurized fuel from the low pressure fuel pump;

further pressurizing the pressurized fuel using a high pressure fuel pump; and supplying high pressure fuel to a plurality of fuel injectors in a plurality of cylinders of the engine, respectively, wherein the engine is a spark-ignition, direct-injection (SIDI) engine, and wherein the high pressure fuel pump is disabled when the fuel level in the fuel tank is less than the predetermined fuel level, when the fuel pressure is less than the predetermined pressure for the first predetermined period, and when the A/F ratio of the engine is greater than the predetermined A/F ratio for the second predetermined period.

* * * * *